United States Patent [19]

Stilwell et al.

[11] 4,294,059

[45] Oct. 13, 1981

[54] BIN FILLING APPARATUS AND METHOD

[75] Inventors: Robert E. Stilwell; David E. Westerling, both of Riverside, Calif.

[73] Assignee: FMC Corporation, San Jose, Calif.

[21] Appl. No.: 123,606

[22] Filed: Feb. 22, 1980

[51] Int. Cl.[3] ..... B65B 35/38; B65B 35/52; B65B 1/16

[52] U.S. Cl. ..... 53/448; 53/538; 53/504; 53/247; 53/248; 198/434; 53/475

[58] Field of Search ..... 53/537, 538, 531, 448, 53/248, 503, 504, 247, 251, 475; 198/462, 461, 445, 446, 620, 434

[56] References Cited

U.S. PATENT DOCUMENTS

| | | | |
|---|---|---|---|
| 2,442,250 | 5/1948 | Spain | 53/537 X |
| 3,318,068 | 5/1967 | Voullaire | 53/247 X |
| 3,465,495 | 9/1969 | Zwiacher et al. | 53/244 X |

*Primary Examiner*—Robert L. Spruill
*Assistant Examiner*—K. Y. Lin
*Attorney, Agent, or Firm*—R. S. Kelly; H. M. Stanley

[57] ABSTRACT

An apparatus receives empty bins and loose articles of random size and shape, such as apples, to be stored within the bins at a fill station. The articles are delivered to an inclined conveyor which has a lower end adjacent to a horizontal conveyor with a stop roller being positioned between the conveyors. When the articles have collected on the inclined conveyor a predetermined distance up the incline, a drive is actuated which simultaneously moves the inclined conveyor upwardly and moves the horizontal conveyor away from the inclined conveyor while rotating the stop roller to permit the articles to move from the inclined conveyor to the horizontal conveyor. This conveyor motion causes the articles to gently cascade down the incline in spread out fashion so that they are transported toward the end of the horizontal conveyor remote from the inclined conveyor and across the entire breadth thereof. A vacuum head, movable between a position overlying the horizontal conveyor and a position within the bin at the fill station, operates in response to detection of a close-packed array of the articles on the horizontal conveyor beneath the head. The vacuum head contains a plurality of vacuum gripping cups spaced apart by distances which are substantially less than the smallest diameter of the articles so that a close-packed array of articles is engaged on the horizontal conveyor and transported within the bin at the fill station where the articles are released and gently deposited.

26 Claims, 17 Drawing Figures

FIG_4
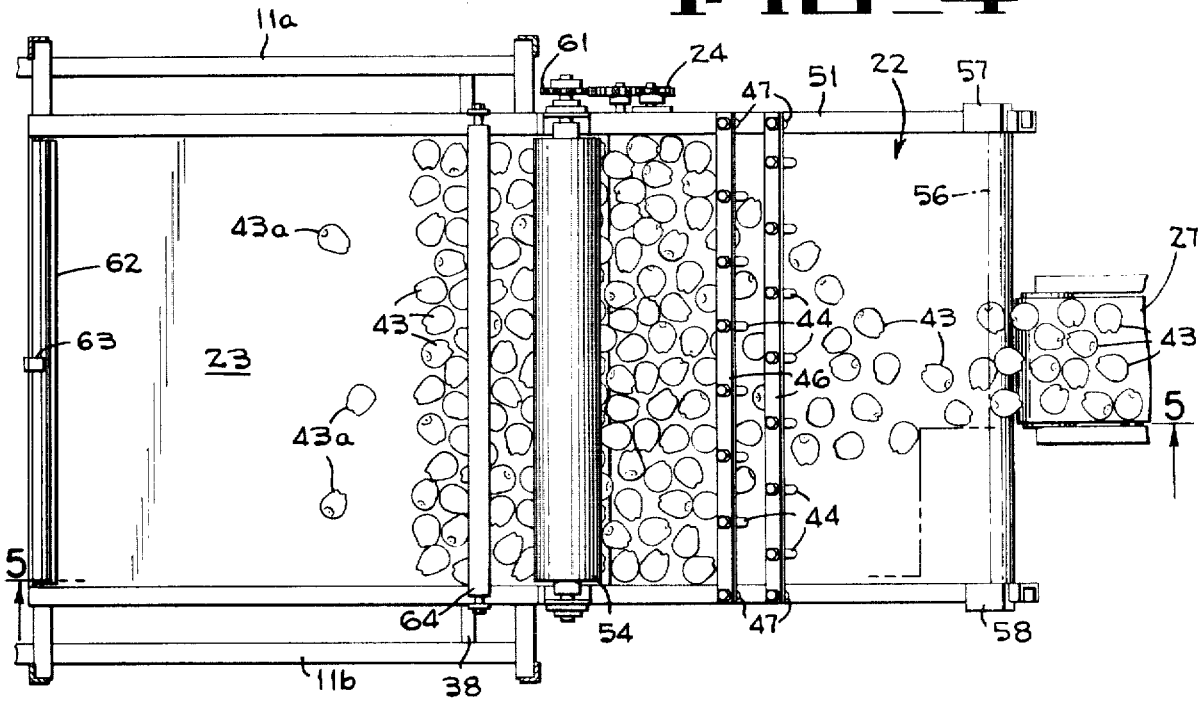
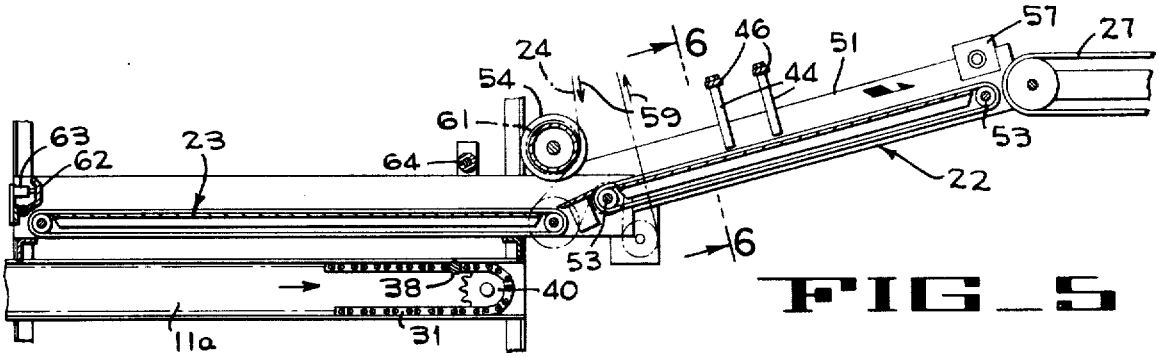
FIG_5
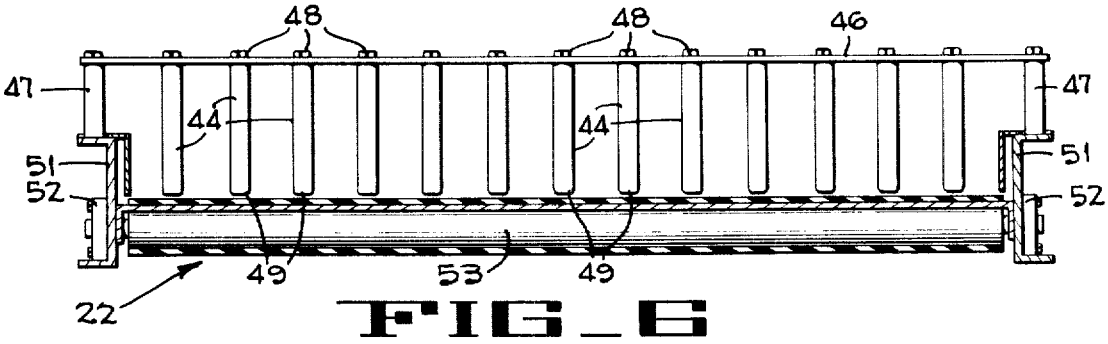
FIG_6

FIG_9
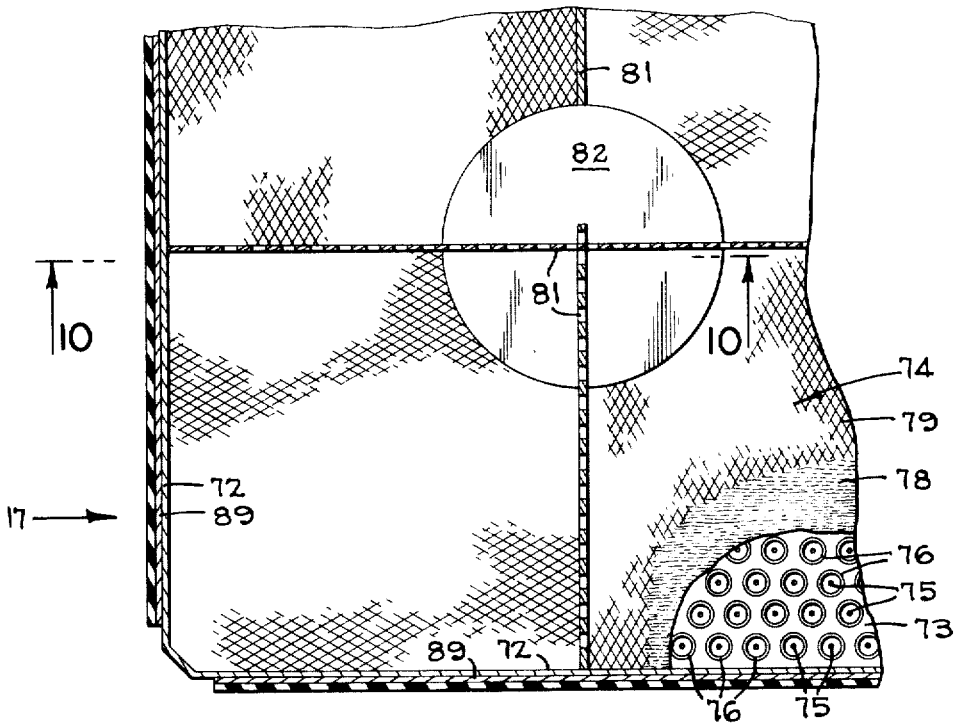
FIG_15
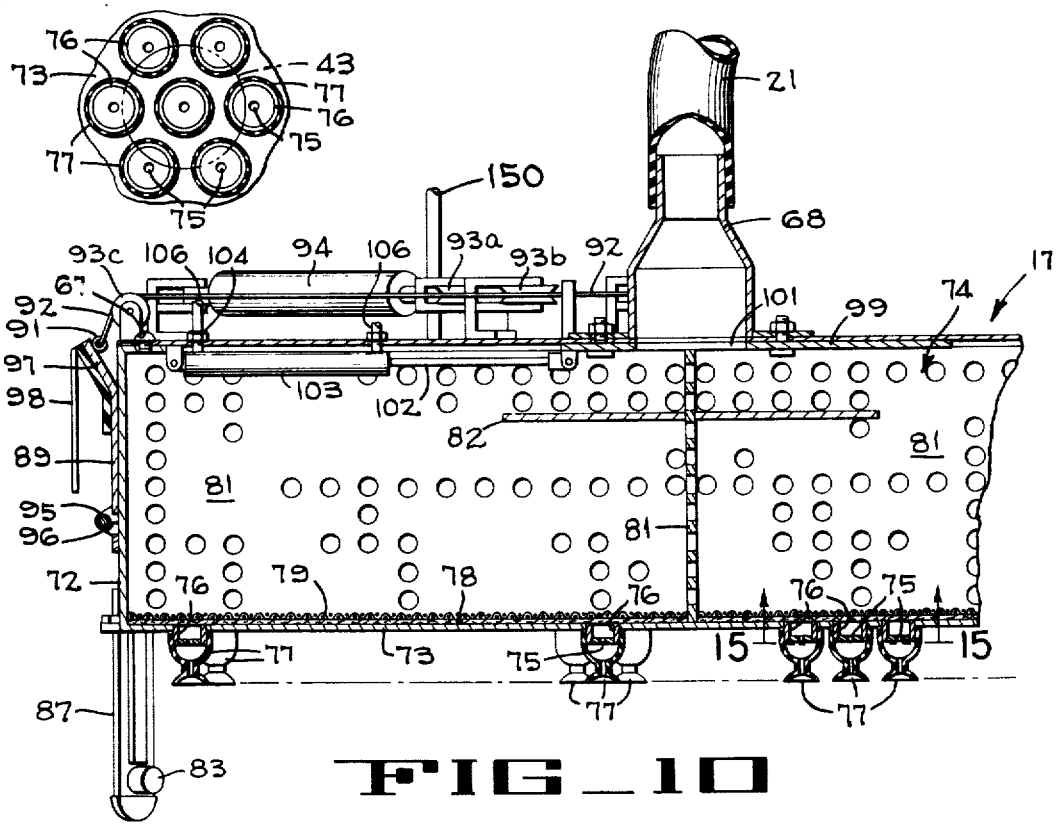
FIG_10

BIN FILLING APPARATUS AND METHOD

BACKGROUND OF THE INVENTION

1. Field of the Invention

This invention relates to apparatus for filling storage bins with produce of random sizes and shapes, and more particularly, to such apparatus which avoids damage to the produce due to excessive contact therebetween or with the apparatus structure.

2. Description of the Prior Art

The accumulation of articles such as fruit, eggs or cans in predetermined patterns and subsequent gripping by overhead vacuum transfer devices for transport to containers is a well known concept. U.S. Pat. No. 3,183,640 to Gee et al discloses such a device for packing cantaloupes which includes a network of conveyors which are disposed to transport the cantaloupes to a station so that the cantaloupes are arranged in a predetermined pattern with each cantaloupe having a predetermined orientation. The cantaloupes are engaged individually at the station by a number of vacuum cups corresponding in number to the number of cantaloupes in the pattern. The array of vacuum cups is surrounded by a plurality of pressure plates which engage the cantaloupes at the outer edge of the pattern being transported. The pressure plates contain flanges which locate the upper edges of packing boxes into which the cantaloupes are to be deposited and engage the outer edges of the packing boxes to thereby align the array of cantaloupes being transported with the packing box into which they are to be received.

A number of other prior United States patents disclose packing devices for loose fruit which include vacuum heads for picking up the fruit from overhead after they have been arranged in a predetermined pattern and for moving the fruit laterally and depositing such fruit as a single layer in a bin or other container. Among these patents are Frost U.S. Pat. No. 3,292,341, Voullaire U.S. Pat. No. 3,318,068, Zwiacher et al U.S. Pat. No. 3,465,495, and Paddock U.S. Pat. No. 3,609,938.

SUMMARY OF THE INVENTION

The present invention concerns a method of packing loose, generally round articles of produce of random sizes and shapes into a bin or other large container without bruising or otherwise damaging the articles where such articles are received in a random feed arrangement on a conventional feed conveyor. The invention contains two principal features which accomplish this objective.

First, in order to get the articles into the bin in a quick and yet gentle manner, the articles are accumulated in a randomly oriented, closely packed, single layer array. Substantially the entire array is picked up from overhead by a vacuum transport head which includes a plurality of spaced vacuum cups to grip the articles, the vacuum cups being individually capable of pivoting laterally with a gimbal motion to grip the rounded surfaces of the articles and being spaced apart by distances substantially less than the smallest diameter of the articles so that all of the articles under the vacuum head will be gripped by at least one cup. The vacuum head is then moved over and into the bin to deposit the layer of articles on the bottom of the bin or atop the top layer of articles in the bin. This process is repeated until the bin is filled to the desired level.

The second feature of the invention includes the means whereby the articles are accumulated in said closely packed array. For this purpose, a spreading conveyor is placed between the feed conveyor and the area in which the articles are accumulated, such spreading conveyor having the width of the accumulation area—which is substantially larger than that of the feed conveyor. The spreading conveyor is inclined upwardly from the accumulation area to the feed conveyor and is arranged to be driven in the opposite direction of the gravitational flow of articles from the feed conveyor to the accumulation area so that said articles are caused to spread out over the width of the spreading conveyor.

BRIEF DESCRIPTION OF THE DRAWINGS

FIG. 4 is an enlarged section taken along line 4—4 of FIG. 1 showing the article spreading and accumulation conveyors.

FIG. 5 is a section taken along line 5—5 of FIG. 4.

FIG. 6 is an enlarged section taken along line 6—6 of FIG. 5.

FIG. 9 is an enlarged fragmentary section taken along line 9—9 of FIG. 8.

FIG. 10 is an enlarged vertical section taken along line 10—10 of FIG. 9.

FIG. 15 is an enlarged horizontal section taken along the line 15—15 of FIG. 10.

DESCRIPTION OF THE PREFERRED EMBODIMENT

Figure 1:
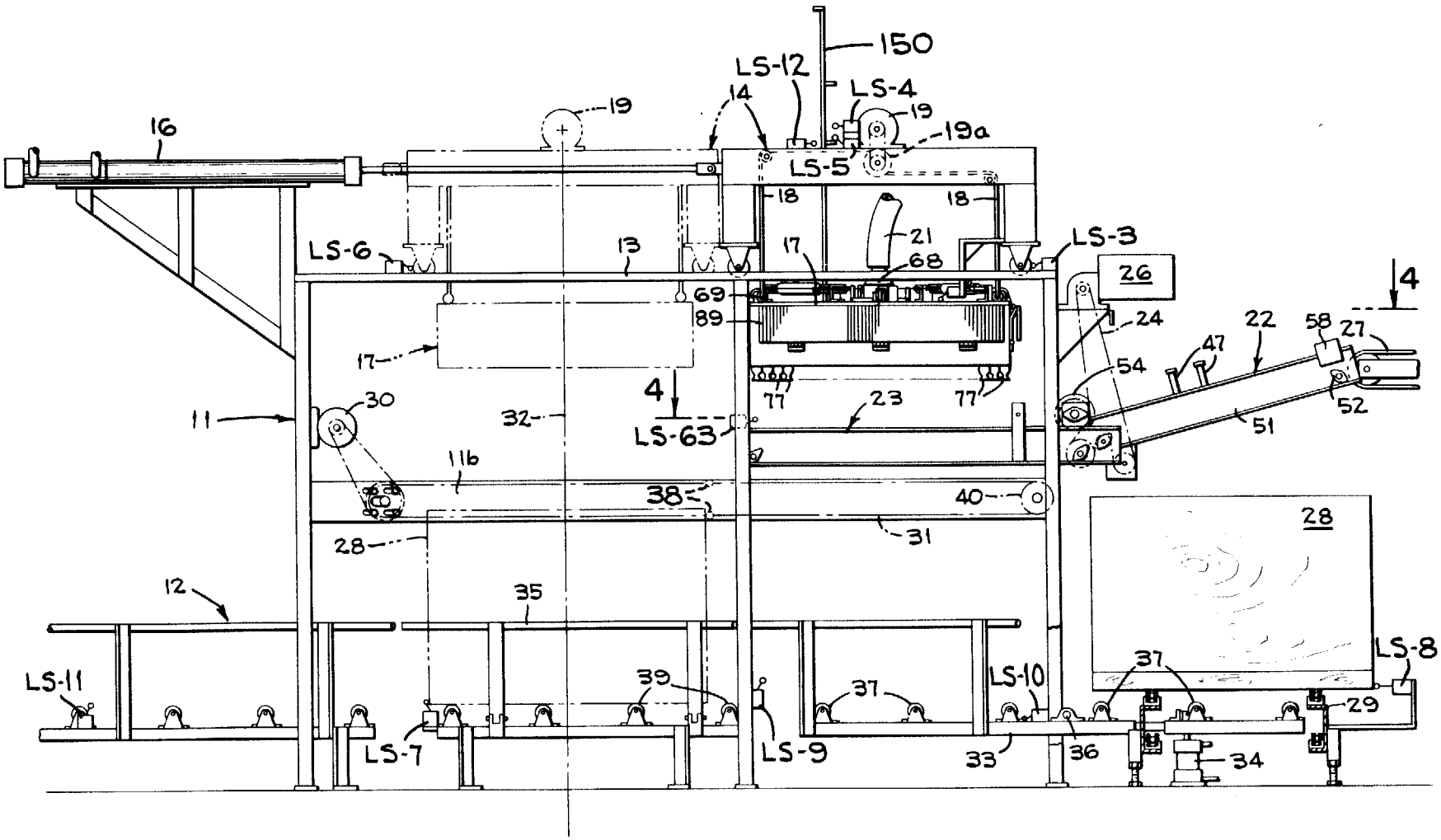
FIG. 1 is a side elevation of the bin filling apparatus of the present invention with a bin in position to be filled being shown in phantom lines and with an alternate position of the vacuum transfer head during filling being shown in phantom lines.

The bin filler disclosed herein is seen in its entirety in FIG. 1 wherein a framework shown generally at 11 supports a lower track assembly 12 configured to transport storage bins and a pair of parallel upper tracks 13 (one only being shown in FIG. 1). A vacuum head carrier 14 is disposed for back and forth motion on the upper tracks 13 as urged by a pneumatic cylinder 16 coupled thereto. A vacuum head 17 is shown suspended below the vacuum head carrier 14 on cables 18 being subject to up and down motion thereon in accordance with drive provided by a reversible vacuum head control motor 19, the motor being connected (as shown) to a pulley 19a with the cables 18 being oppositely wound thereon. A flexible conduit 21 is attached to the vacuum head 17 and is in communication through solenoid-controlled valves (not shown) with a conventional vacuum pump (not shown) for evacuating the vacuum head 17 to a predetermined low level of vacuum relative to the ambient pressure. The vacuum pump used in this invention should be one with a flat characteristic curve wherein it is capable of putting out a relatively constant vacuum over a wide range of evacuating flow rates. Evacuation to a level in the range of five to six inches of mercury vacuum has proven to be satisfactory for this application.

An inclined endless flat belt spreading conveyor 22 (best seen in FIGS. 4–6) is attached to the framework 11 at one end thereof providing an upper conveyor reach which is driven upwardly on the incline. A horizontally disposed endless flat belt accumulation conveyor 23 (FIGS. 4 and 5) is provided with one end adjacent to the lower end of the inclined conveyor 22. The horizontal accumulation conveyor provides an upper conveyor reach which is driven away from the inclined spreading conveyor 22. The conveyors 22 and 23 are driven simultaneously through a drive chain 24 by a conveyor motor 26. The inclined conveyor 22 is adapted to receive a supply of loose articles of produce, which in the described embodiment are apples, from an endless flat belt supply conveyor 27 adjacent to the upper end of the incline. It will be noted (from FIG. 4) that the width of the supply conveyor 27 is substantially less than that of the spreading conveyor 22. The spreading conveyor receives the apples from the supply conveyor as they gravitate down the incline, and the apples are allowed to accumulate at the bottom of the incline until they accumulate to a predetermined distance on the inclined surface of the spreading conveyor. When the accumulated apples on the spreading conveyor 22 reach the predetermined inclined distance, the conveyor motor 26 is switched to an on condition, and the spreading conveyor 22 and accumulation conveyor 23 are operated so that their respective conveyor reaches run in opposite directions. Consequently, the apples on the inclined spreading conveyor 22 gently cascade down the incline tending to spread out at the bottom thereof and to enter the horizontal conveyor reach of the accumulation conveyor in a spread out arrangement extending across the breadth of the accumulation conveyor. The conveyors are run for a predetermined amount of time, e.g., five to fifteen seconds, unless stopped sooner when the closepacked, random array of apples is advanced completely across the accumulation conveyor to the distal end thereof to signal the vacuum head that its picking operation can be started. The motor 26 is then stopped, and the supply conveyor 27 continues to provide apples to the spreading conveyor until the predetermined accumulating distance up the incline is once again reached. The sensed predetermined accumulation level again is used to actuate the conveyor motor 26, and the close-packed random array of apples extending across the breadth of the accumulation conveyor 23 is once again advanced thereon in a direction away from the spreading conveyor 22.

When the close-packed array of apples reaches the end of the accumulation conveyor 23 which is remote from the inclined spreading conveyor 22, the presence of the array at the remote end is sensed to actuate the motor 19 and lower the head 17 on the cables 18. A vacuum is present in the vacuum head 17 through the flexible conduit 21 while the vacuum head 17 is lowered. The motor causes the cables to lower until the close-packed array of apples on the accumulation conveyor is engaged by vacuum cups 77 depending from the vacuum head 17. The lowering movement of the vacuum head is then stopped, the motor 19 is reversed, and the head is elevated. After the head has been elevated a predetermined distance the pneumatic cylinder 16 is actuated to move the vacuum head carrier 17 laterally on the upper tracks 13 to a position overlying a filling station 32 (FIG. 1). KThe vacuum head control motor 19 is then again reversed to lower the vacuum head 17 on the cables 18 so that the head and the close-packed array of apples enters the open top of a storage bin 28 at the filling station. The underlying surface in the storage bin 28, whether it be the bottom of the bin or the last deposited layer of apples, is sensed and the vacuum in the vacuum head is terminated. The close-packed array of apples is therefore released within the storage bin 28, and the vacuum head control motor 19 is reversed to hoist the vacuum head to the elevated position. The pneumatic cylinder 16 then repositions the vacuum head carrier 14 in its initial position overlying the accumulation conveyor 23. Continued repetition of the foregoing sequence provides a storage bin 28 filled to a predetermined level. At such time the filled storage bin 28 is advanced from the filling station 32 by an endless bin advance conveyor 31, having pusher bars thereon, and another empty storage bin 28 is positioned at the filling station.

A storage bin 28 is shown in FIG. 1 on a bin feed track 29 which is oriented at approximately right angles to the lower track assembly 12. The lower track assembly is configured to accept empty storage bins 28 from the feed track 29. The empty storage bins 28, after transfer to the lower track assembly 12, are advanced therealong by the overlying bin advance conveyor 31 to the filling station shown at 32 in FIG. 1.

Figure 2:
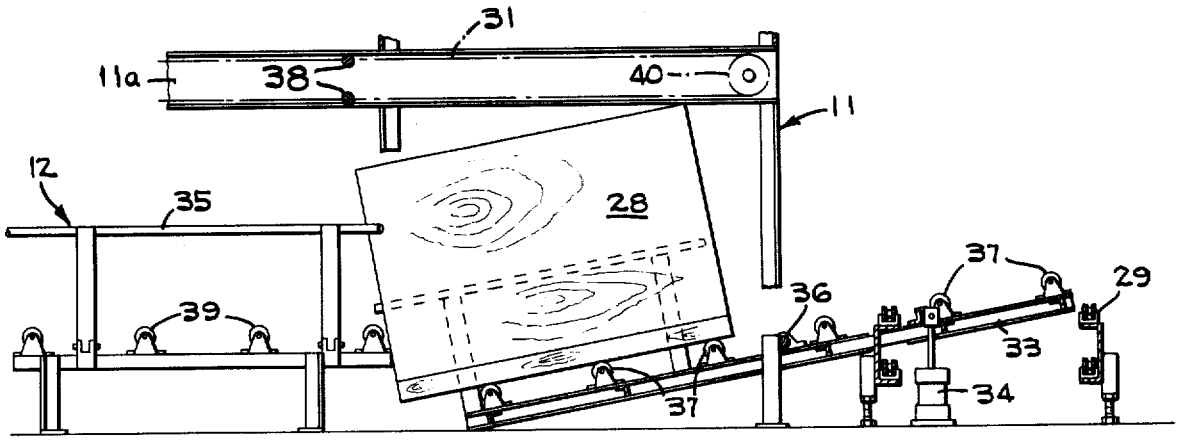
FIG. 2 is a fragmentary side elevation showing the mechanism for placing an empty bin into position to be filled.
Figure 3:
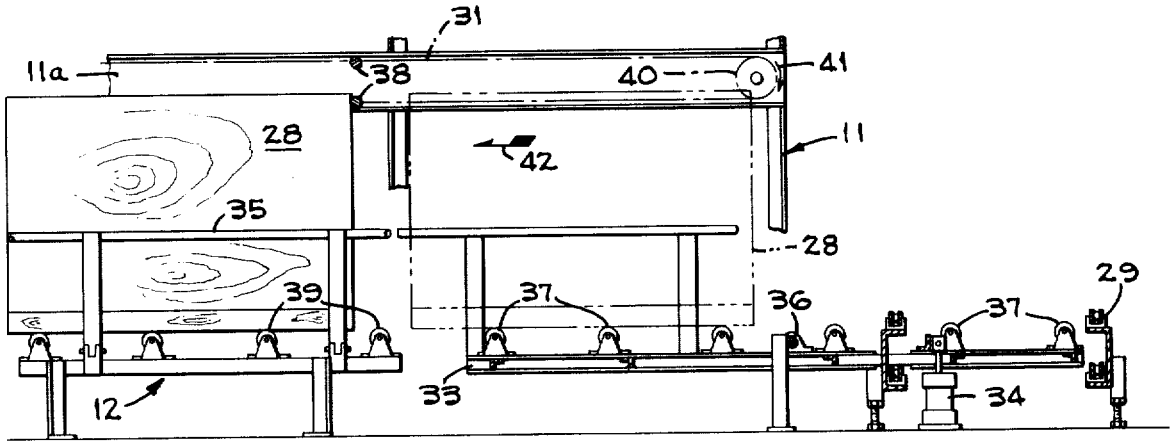
FIG. 3 is a fragmentary side elevation similar to FIG. 2 showing the empty bin in position to be filled and with the prior feeding position of the bin being shown in phantom lines.

The details of the manner in which the storage bins 28 are delivered from the bin feed track 29 and directed along the lower track assembly 12 are shown in FIGS. 2 and 3 with the details of the bin advance conveyor 31 being shown in FIG. 5. When a storage bin reaches the position on the bin feed track adjacent to the end of the lower track assembly 12, as shown in solid lines in FIG. 1, a tilting section 33 of the lower track assembly 12 is pivoted to the position seen in FIG. 2 by a pneumatic piston and cylinder assembly 34 when the piston is extended upwardly. The tilting track section 33 is pivoted at a pin 36 which connects the tilting section to the framework 11. It will be seen from FIG. 2 that the empty storage bin 28 will slide toward the lower end of the tilting section 33 on the rollers 37 forming the support surface thereof. When the storage bin 28 has reached the lower end of the tilting section 33, the pneumatic cylinder assembly 34 is actuated to return the tilting section of the lower track assembly to its normal horizontal orientation as seen in FIG. 3. After the tilt section 33 is returned to its horizontal position, the bin advance conveyor 31 may be actuated so that one of two cross bars 38 carried thereon will engage the trailing edge of the empty storage bin and urge the bin to move over a plurality of rollers 39 (similar to rollers 37) on the lower track assembly 12 in the direction shown by arrow 42 (FIG. 3) to the filling station 32. The bin is aligned laterally on the lower track assembly 12 by a pair of side positioning frame bars 35 (one only shown in FIGS. 2 and 3). The bin advance conveyor 31 is stopped when the storage bin reaches the filling station 32, and the bin remains positioned at the filling station until the filling operation is completed.

The manner in which the cross bars 38 are carried on the bin advance conveyor 31 may be seen by reference to FIG. 5. The bin advance conveyor 31 is there shown as a continuous chain passing around a sprocket 40. A pair of such continuous chains are mounted on either side of the conveyor 23 and slightly therebelow on framework members 11*a* and 11*b*, as best seen in FIG. 4. The bars 38 are connected at the ends thereof between the two continuous chains so that as the bin advance conveyor sprocket 40 turns in the direction of the arrow 41 in FIG. 3, the upper bar 38 shown therein will advance around sprocket 40 to engage the empty bin 28 and square the bin laterally on the lower track 12 while urging it toward the filling station 32. The bin advance conveyor 31 is arranged to be driven by a motor 30 connected to the sprocket at the downstream end of the conveyor as shown in FIG. 1.

Referring now to FIGS. 4, 5 and 6, it may be seen that apples 43 are delivered along the supply conveyor 27 to the inclined spreading conveyor 22. The apples have somewhat irregular, but generally round shapes which permit them to roll. The apples roll down the incline on conveyor 22 contacting a plurality of overlying resilient fingers 44 as they roll which fingers tend to slow the apples so that they do not contact preceding apples with enough force to cause damage from bruising. The fingers 44 are arranged in a double row as seen in FIGS. 4 and 5. The two rows are staggered so that substantially every apple will be contacted by at least one finger and slowed down, but sufficient space is maintained between the fingers to allow the apples to readily pass therethrough toward the lower end of the inclined conveyor 22. The array of fingers 44 is best seen in FIG. 6 extending across the width of the spreading conveyor 22 and being suspended thereabove on a support bar 46 mounted on two end pedestals 47. The resilient fingers are each secured to the bar 46 by means of a short bolt 48 extending through an aperture in the support bar 46, and each finger is comprised of a soft plastic tube 49 surrounding the portion of the bolt 48 extending below the support bar and being secured thereto by frictional engagement. The endless belt spreading conveyor 22 is relatively conventional in nature including two side rails 51 (FIG. 6) upon which the end pedestals 47 are supported and upon which journals 52 are provided for supporting a conveyor roller 53 at each end of the conveyor reach (FIG. 5).

The manner in which the apples 43 are delivered to the inclined spreading conveyor 22 is shown in FIG. 4 wherein it will be seen that the apples which are deposited on the inclined surface of conveyor 22 roll toward the lower end thereof past the resilient fingers 44. The apples will collect near the lower end of the inclined conveyor reach as they contact and are stopped by a soft roller 53 which overlies the adjacent ends of the conveyors 23 and 22. The apples collect in a single layered mass which rises up the incline as additional apples are deposited thereon by the supply conveyor 27. A predetermined maximum level on the inclined spreading conveyor for the single layer of apples is represented by a line 56 (FIG. 4) extending between a light source 57 and a photocell 58 which are mounted on the side rails 51 at the opposite sides of the inclined spreading conveyor. When the upper level of the accumulated mass of apples on the spreading conveyor reaches the line 56, the beam from the light source 57 is broken and a control signal is provided by the photocell 58 (in a manner to be explained hereinafter) to energize the accumulation conveyor motor 26. It is apparent from FIG. 4 that each apple 43 passing down the conveyor 22 will break the beam from the light source 57. However, a time delay circuit is provided for the control signal from the photocell 58 so that the conveyor motor 26 will not be energized until the apples are at rest in a static condition between the light source and the photocell. The time delay (i.e., the continuous time required for the beam from light source 57 to be broken) is in the order of 3 seconds so that a distinction may be made between moving apples rolling down the incline (where the photocell receives light briefly between apples) and apples in a static condition which are stacked up to the level of the line 56.

When the beam from the light source 57 has been interrupted for the length of time sufficient to indicate the presence of apples in a static condition at the level of the line 56 (and the accumulation conveyor motor 26 has therefore been energized), the drive chain 24 for conveyors 22 and 23 is driven in the direction of the arrows 59 as seen in FIG. 5. It may be seen that with the routing of the drive chain 24 as indicated the horizontal accumulation conveyor reach 23 will move toward the left (as seen in FIG. 5) and the inclined spreading conveyor reach 22 will move in an opposite direction up the incline toward the right. Drive chain 24 also engages a sprocket 61 (FIG. 5) fixed to the end of the shaft upon which the soft roller 54 is mounted. The soft roller is therefore driven in a clockwise direction (as seen in FIG. 5) so as to urge the apples passing from the lower end of the spreading conveyor 22 onto the adjacent end of the accumulation conveyor 23. The upward movement of the spreading conveyor reach tends to agitate the apples thereon as they are urged by gravity back toward the lower end of the conveyor and to thereby cause some apples in the single layer of apples to fall toward the outer edges of the conveyor and thereby fill up the entire width of the spreading conveyor with apples. Thus, a close-packed, spread out array of apples in random formation (spread to the full width of the conveyor 22) is presented to the end of the accumulation conveyor to be passed underneath the soft roller 54 so that said close-packed random array can be carried away from the spreading conveyor as a unit by the horizontal accumulation conveyor. The soft roller 54 serves to positively feed the apples in the close-packed spread out array onto the accumulation conveyor and also serves (when not driven) to gently stop the initial apples which roll down the spreading conveyor and that form the next row of apples to be fed thereby. It may therefore be seen from FIG. 5 that the spreading conveyor 22, the accumulation conveyor 23 and the soft roller 54 are driven simultaneously. The drive has a maximum duration of approximately ten seconds so that the apples are delivered onto the horizontal accumulation conveyor without exhausting the supply of apples on the inclined spreading conveyor. Therefore, the possibility of voids appearing in the close-packed array on the accumulation conveyor is minimized.

FIG. 4 shows a close-packed array of apples 43 moving toward the end of the horizontal accumulation conveyor 23 which is remote from the inclined spreading conveyor 22. When the close-packed array of apples reaches the remote end of the accumulation conveyor 23, the apples will bear against a pivotably mounted end bar 62 extending transversely across the remote end of the accumulation conveyor. Immediately behind the pivotable end bar is located a limit switch 63 which senses the pressure of the advancing close-packed array of apples against the end bar. Actuation of the limit switch 63 produces a signal (by means to be explained in detail hereinafter) which is utilized to energize the vacuum head control motor 19 so that the vacuum head 17 is lowered to engage and pick up the close-packed array of apples on the accumulation conveyor.

Figure 11:
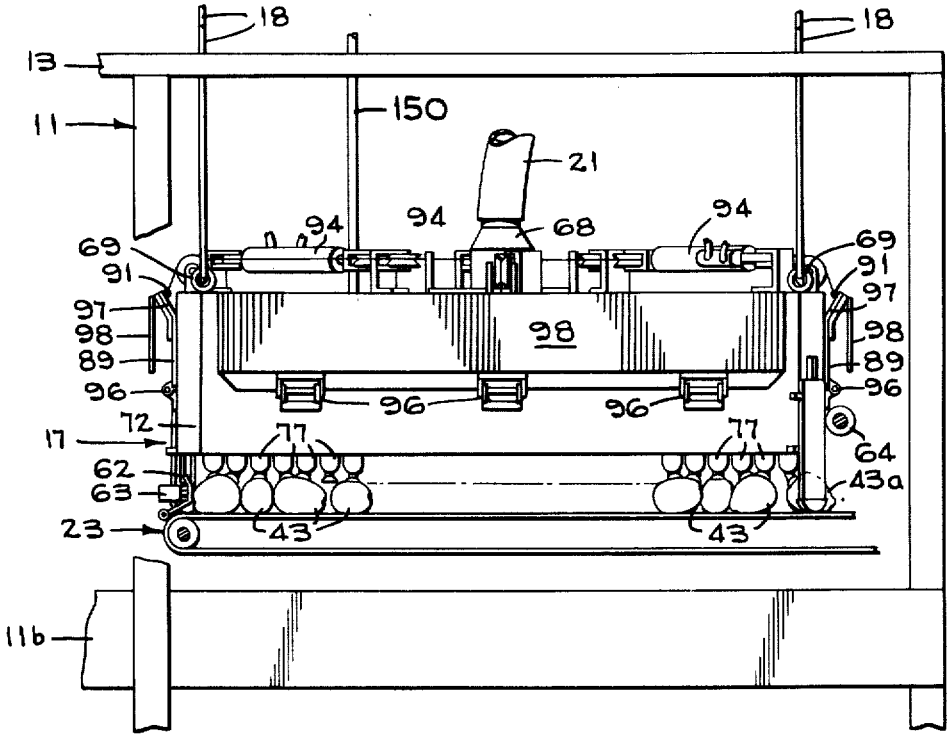
FIGS. 11-14 are operational views of the vacuum transfer head showing the pickup, transfer and discharge of the articles into a bin.
Figure 12:
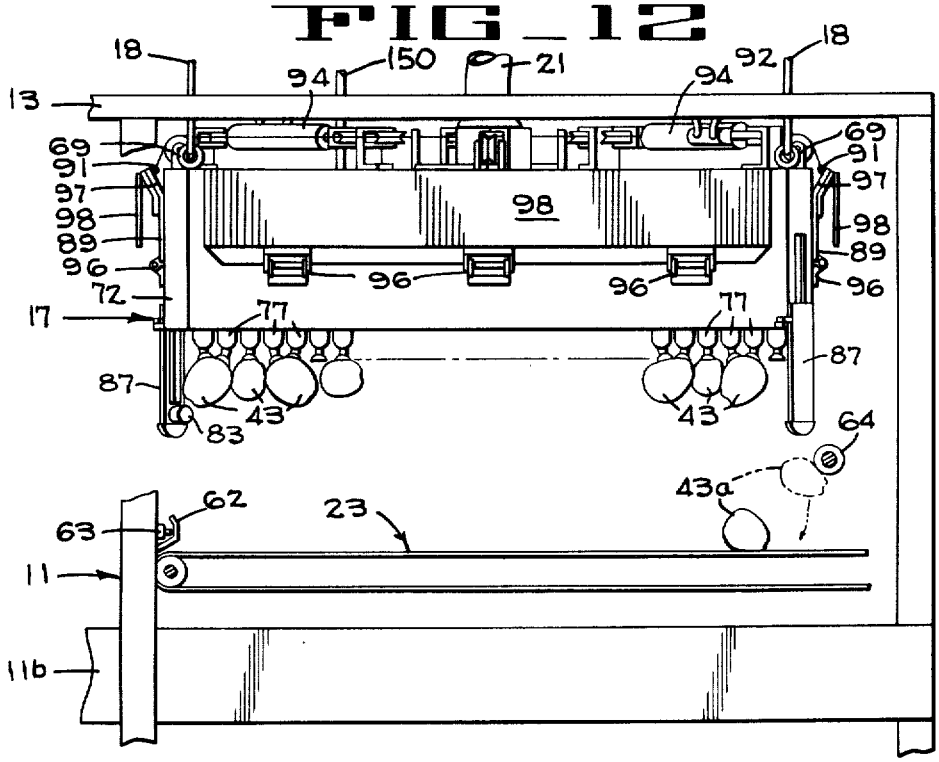

A static trimming bar 64 is shown (FIGS. 4 and 5) disposed upon the framework 11 in a position overlying the horizontal accumulation conveyor 23. This trimming bar performs a function best described with reference to FIGS. 11 and 12. The trimming bar 64 is positioned at an elevation so as to allow the apples 43 to pass therebeneath on the accumulation conveyor. When the closepacked array of apples is engaged by suction cups 77 of the vacuum head 17 and the vacuum head control motor 19 is subsequently controlled to raise the vacuum head, any apples 43 on the trailing end of the array which are engaged by the vacuum head in such a fashion that a portion of an engaged apple entends beyond the edge of the vacuum head will hit the trimming bar 64 as the vacuum head is raised so as to be disengaged from the vacuum head to fall gently back to the surface of the conveyor 23. Vacuum head 17 is shown in FIG. 11 in a position directly overlying the accumulation conveyor 23 wherein the apples 43 are being engaged by the vacuum cups 77 on the head. Apple 43*a* is also engaged in such a fashion that a portion of the apple 43*a* extends laterally beyond the dimensional limits of the vacuum head 17. When the vacuum head is subsequently moved upwardly by the cables 18, the apple 43*a* is not free to move inwardly to a point within the dimensional limits of the vacuum head because such space is occupied by the other apples in the close-packed array. Thus, the apple 43*a* is gently disengaged from the vacuum head 17 by the trimming bar 64 as it is contacted thereby as shown in FIG. 12. The disengaged apple 43*a* therefore falls gently back to the surface of the accumulation conveyor and is subsequently advanced thereby toward the pivotable end bar 62. Several apples 43*a* are shown in FIG. 4 ahead of the advancing close-packed array of apples 43 for illustration purposes to indicate those apples previously removed by the trimming bar from the portion of the array picked up by the vacuum head.

A description of the structural details of the vacuum head 17 will now be undertaken with reference to FIGS. 7 through 10 wherein a top or cover plate 66 is shown fastened to the vacuum head 17 by a series of screw-type fasteners 67. A tubular adapter housing 68 is shown bolted to the center of the cover plate 66 for affixing the flexible conduit 21 which communicates with the vacuum pump (not shown). The vacuum head 17 is rectangular to assume the shape of the receiving bin 28 and the pattern of apples on the accumulation conveyor 23 to be transported to the bin. An eye 69 is affixed to each corner of the cover plate 66 so that one support cable 18 may be affixed to each of the four corners of the vacuum head to maintain the head in a stable horizontal position as it is raised and lowered.

As best seen in FIGS. 9 and 10, four vertical interconnected side walls 72 are provided for the vacuum head 17. A bottom plate 73 (FIG. 10) is provided which extends between the four vertical side walls 72 and which, in conjunction with the cover plate 66, defines a plenum chamber 74 within the vacuum head 17. The bottom plate 73 has a plurality of closely spaced holes drilled therethrough which accept collars 76 (FIG. 10). The collars are fixed in the bottom plate, and each has a small hole 75 extending through the end thereof as best seen in FIG. 15. The resilient vacuum cups 77 are drawn around the peripheries of the collars 76 and may be secured thereto either by means such as an adhesive or merely by friction engagement. The vacuum cups are spaced apart by distances which are substantially smaller than the smallest mean diameter of the apples so that at least one cup will be in engagement with every apple under the vacuum head (FIG. 11) and most apples will be engaged by two or more cups. Immediately above the bottom plate 73 in the plenum chamber is disposed a layer of fiberglass wool 78 (FIG. 10) which functions as both a filter and a pressure distribution means. A heavy mesh screen 79 overlies the layer of fiberglass wool primarily for the purpose of retaining the wool in place at the bottom of the plenum chamber 74. The plenum chamber is split into quadrants by perforated cross plates 81 which serve to provide structural strength to the walls of the plenum chamber. A horizontally disposed imperforate disc 82 is attached to the perforated cross plates within the plenum chamber 74 a short distance below the aperture in the cover plate 66 which is surrounded by the adapter housing 68. The function of the cross plates 81, the disc 82 and the fiberglass wool 78 is to uniformly distribute the pressure in the plenum chamber and to suppress any vortex action within the plenum chamber as the pressure therein is drawn down below ambient pressure. In this fashion the vacuum pressure is maintained at substantially the same level at each of the vacuum cups 77. Moreover, due to the small diameter of the holes 75 in the collars 76 the pressure differential between the plenum chamber 74 and ambient pressure is capable of being maintained even though some of the vacuum cups 77 do not engage any apples during a pickup operation and remain in communication with the ambient pressure level to thus draw in ambient air through the holes 75. It should again be noted that the collars 76 and associated vacuum cups 77 are positioned in the vacuum head bottom plate 73 so that the distance between centers of the small holes 75 is substantially less than the mean diameter of the smallest apples to be picked up by the vacuum head. This is shown in FIG. 15 wherein an average sized apple 43, shown in dashed lines, may clearly be engaged by more than one vacuum cup due to the high density of cups in the bottom plate.

As best seen in FIG. 10 of the drawings, a combination light source and photocell device 83 is suspended below the vacuum head 17 so as to project a light beam 84 (FIG. 8) at a sufficient distance below the vacuum cups 77 to clear any apples 43 engaged by the vacuum cups. The light source of the device 83 is energized through electrical leads 71 (FIG. 7) connected to the vacuum head. The light beam 84 is directed in a horizontal path diagonally across the vacuum head so as to be intercepted by a reflector 86 also suspended from the vacuum head below the vacuum cups 77. Light reflected from the reflector 86 and received by the photocell of device 83 provides an electrical output signal on the electrical leads 71 to control the operation of the vacuum head, as will be explained in greater detail hereinafter. As best seen in FIG. 8, the light source and photocell 83 as well as the reflector 86 are suspended below the vacuum head 17 on slidable brackets 87 which are keyed into slots at the opposed corners of the vacuum head. When the vacuum head is lowered into a position to cause the brackets 87 to engage underlying apples the brackets will simply slide upwardly and not hinder the further small downward movement of the vacuum head. As the vacuum head 17 is lowered into the interior of a storage bin 28 either the underlying layer of apples 43 (FIG. 14) already within the bin will eventually block the light beam 84 before the layer of apples on the vacuum head contacts such underlying layer or one of the reflector 86 or light source/dectector 83 will be forced upwardly when their bracket 87 abuts the underlying layer until the light beam 84 is broken by the apple layer carried by the vacuum head. This sensed level of the uppermost layer of apples already within the storage bin operates to provide a signal from the photocell which is used to control the vacuum head control motor 19 to halt the downward movement of the vacuum head as described hereinafter. The same signal is also utilized to interrupt the communication between the plenum chamber 74 and the vacuum pump so that the layer of apples 43 carried by the vacuum head can be released and allowed to fall through the minimal distance between the uppermost layer in the bin and the level at which the vacuum head was arrested in its downward movement. The distance through which the apples fall is sufficiently small so that the impact between the uppermost layer of apples and the released layer of apples is small. Thus, no bruising occurs.

Figure 7:
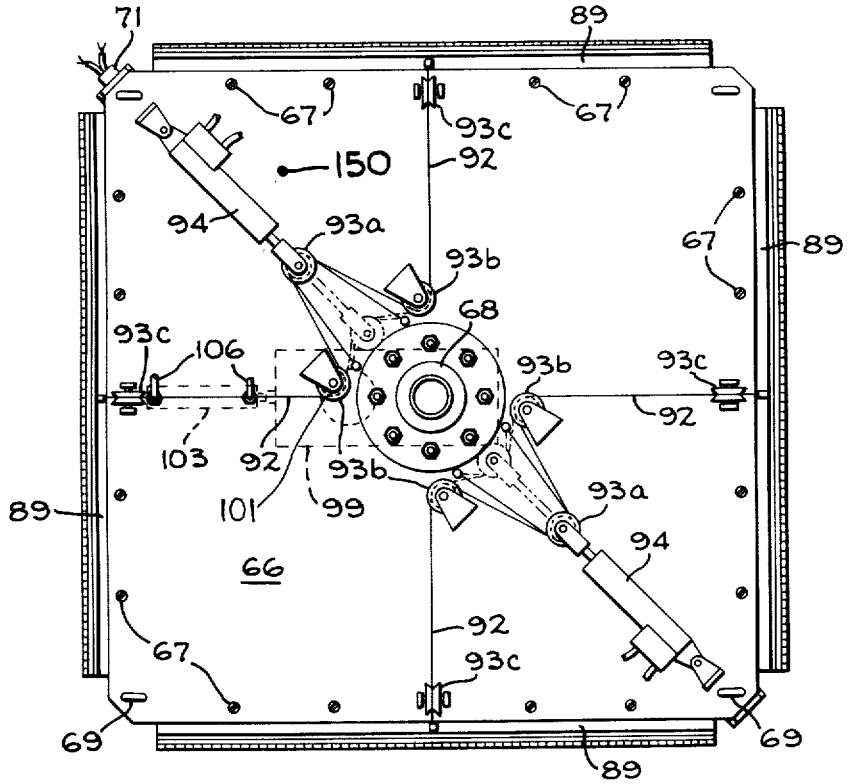
FIG. 7 is a top plan view of the vacuum transfer head.
Figure 8:
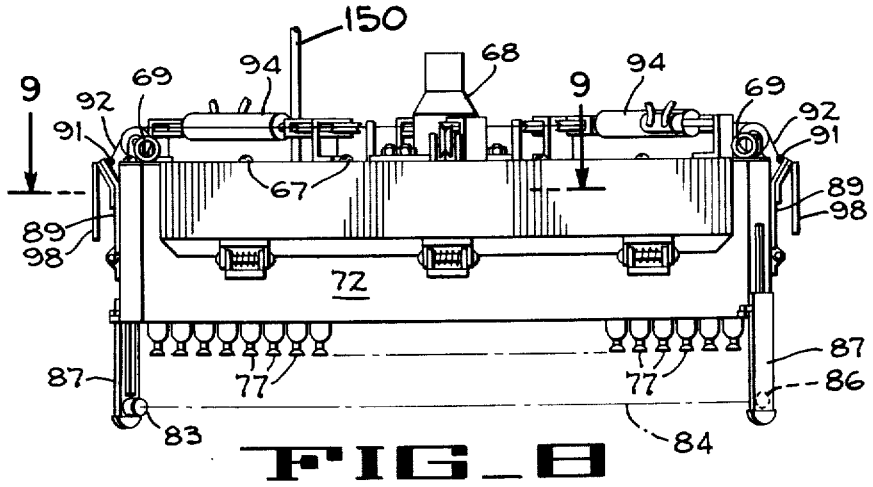
FIG. 8 is a side elevation of the vacuum head of FIG. 7.
Figure 13:
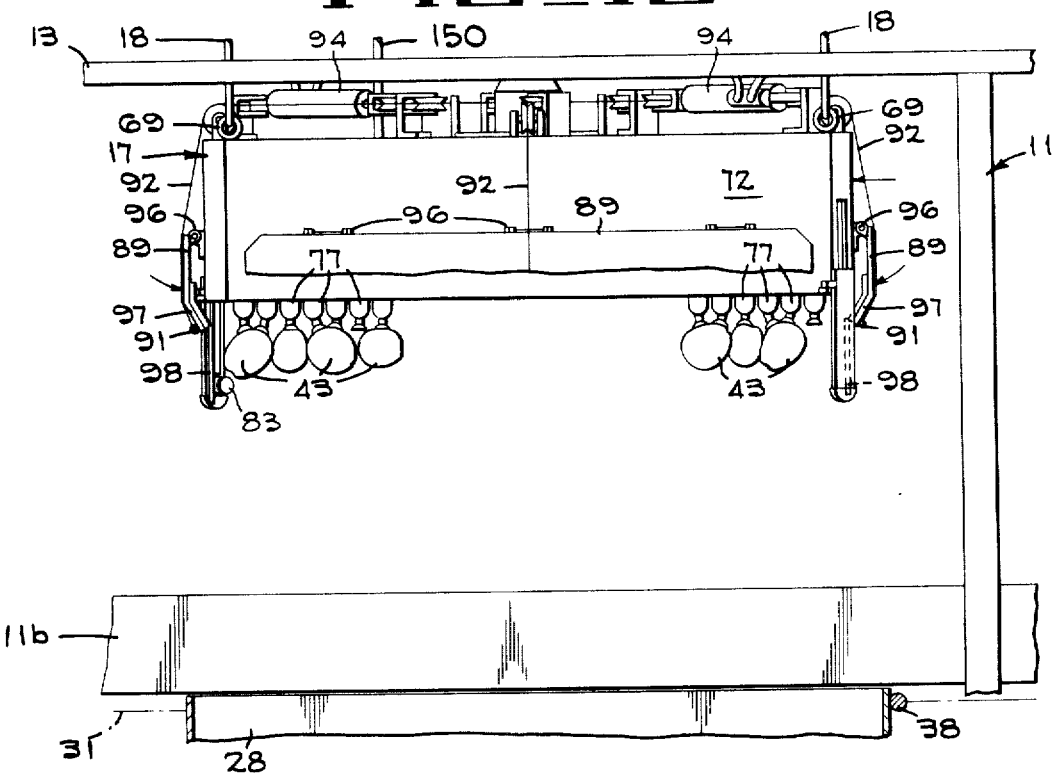
Figure 14:
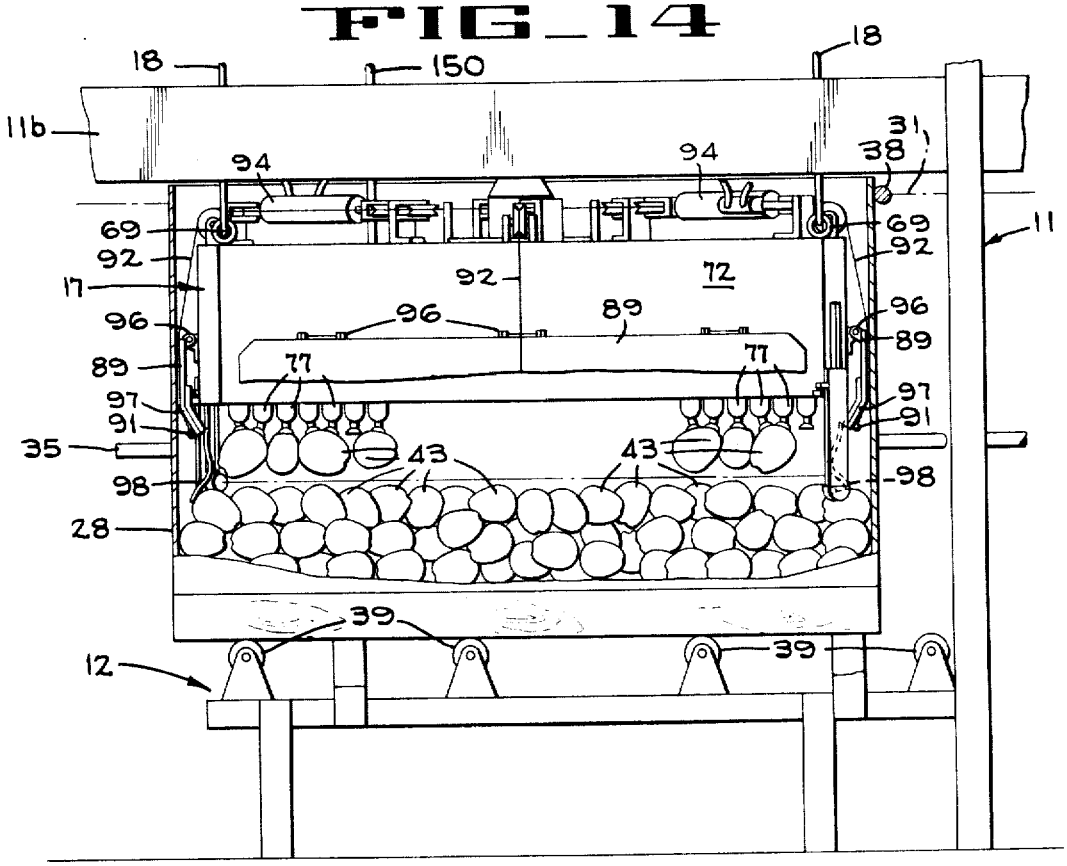

As seen in FIGS. 7 and 8, each vertical sidewall 72 of the vacuum head 17 has attached thereto a hinged and foldable flap 89 for aiding in the gentle placement of the apples 43 within a bin 28. Each of the hinged flaps 89 is pivotally disposed for motion between a folded retracted position (as seen in FIGS. 11 and 12) and an extended depending position (as seen in FIGS. 13 and 14). The manner in which the flaps 89 are actuated between the retracted and extended positions must be such that the extension and retraction mechanism does not interfere with the inside surfaces of the walls on the storage bins 28 as the vacuum head 17 is inserted therein and retracted therefrom. The flaps 89 are raised and lowered by cables 92 which are connected to eyelets 91 attached to the flaps. The cables of adjacent pairs of flaps are connected to and driven by a pair of pneumatic cylinders 94 arranged diagonally at opposed corners of the vacuum head (FIG. 7). As shown in FIG. 7, each cable 92 is entrained on a first pulley **93*a* attached to the piston of the associated cylinder 94, a second pulley 93*b* mounted to the cover plate 66 adjacent the center thereof and a third pulley 93*c* mounted to the cover plate adjacent the side edge thereof. The two cables 92 connected to a single pulley 93*a* are entrained in opposite directions about such pulley 93*a* so that when the piston is retracted within the associated cylinder 94, both flaps 89 connected to the cables will be elevated. The flaps are spring-loaded toward their extended positions, shown in FIGS. 13 and 14, by appropriate coil springs 95 inserted in the hinges 96 supporting the flaps 89 on the vertical sidewalls 72. As will be described hereinafter in greater detail, the pneumatic cylinders 94 are controlled by single-acting solenoid valves such that the cylinders normally maintain the flaps in their retracted positions. When the solenoid valves are actuated to reverse the air flow to the cylinders, the pistons of the cylinders extend to permit the springs 95** to lower the flaps.

The flaps 89 each have an angled portion 97 which extends inwardly when the flap is extended (FIG. 14) and which is configured to guide the vacuum head 17 into the opening in the top of a storage bin 28. Depending from the angled portion 97 of each flap is a flexible fringe 98 of a yieldable flexible material. The flexible fringe is positioned so that as the vacuum head 17 is lowered into the interior of one of the storage bins 28, the fringe will enter that portion of the bin between the bin wall and the uppermost layer of apples deposited therein. This area within the bin near the sidewalls thereof is usually devoid of apples for the uppermost layer or two since the close-packed array of apples is released centrally within the bin. The flexible fringe therefore operates to cushion the fall of the apples into the void existing between the edges of the uppermost layers and the bin sidewalls. In this fashion damaging shocks to the apples are avoided.

The plenum chamber 74 is in communication with the vacuum pump for evacuating the plenum chamber through the flexible conduit 21, as explained hereinbefore. The low pressure is induced continuously in the plenum chamber 74 from the moment the vacuum head 17 moves from the filling station 32 back toward the pick-up station to the moment it is in position to deposit the subsequently picked-up apples 43 into the storage bin. The continuous evacuation of the plenum chamber 74 is interrupted when the vacuum head is positioned immediately above an underlying layer of apples in the bin so that the apples may be released from the vacuum head. The control signal provided by the photocell 83, briefly explained hereinbefore, is utilized to cut off communication between the plenum chamber 74 and the vacuum pump evacuation apparatus so that the pressure within the plenum chamber may be allowed to return to ambient whereby the apples engaged by the vacuum cups 77 will be released. It will be appreciated that during a pickup operation not all of the cups 77 will be in engagement with apples due to the close up spacing; hence, the unengaged cups will act to quickly equalize the pressures once the vacuum source is cut off so that the apples will be quickly released. As illustrated in FIG. 7, a valve plate 99 is shown in dotted lines underlying the cover plate 66 on the vacuum head 17. The valve plate is disposed adjacent to the inside surface of the cover plate 66 for sliding motion relative thereto on appropriate guideways attached to the cover plate. The valve plate 99 has a hole 101 formed therethrough which is substantially the same size as the aperture in the cover plate surrounded by the adapter housing 68 (see FIG. 10). The hole 101 is shown in FIG. 7 as being out of registration with the hole through the cover plate 66, which position is assumed when the apples are to be released from the suction cups. The valve plate 99 is coupled to a piston rod 102 extending from a pneumatic cylinder 103 located beneath the cover plate 66. Fittings 104 (FIG. 10) extend through the cover plate, and flexible hoses 106 are attached thereto. Air flow to the hoses from an appropriate remote pressure source is controlled by a single-acting solenoid valve (not shown).

In the cut away portion of the vacuum head 17 shown in FIG. 10, the piston rod 102 is seen to be in the extended position. With the piston rod 102 in such extended position as shown, the valve plate hole 101 is in registration with the hole in the top plate 66 surrounded by the adapter housing 68 so that the plenum chamber 74 is in communication through the conduit 21 with the vacuum pump. As previously stated, the valve plate 99 is normally positioned as shown in FIG. 10. The open position of the valve plate 99 as shown in FIG. 10 is maintained from the time that the vacuum head is moved out of the filling station 32 back to the pickup position until the vacuum head is moved to the discharge position shown in FIG. 14. Upon the sensing of the discharge position of the vacuum head 17 (shown in FIG. 14) by the photocell 83, the valve plate 99 will be actuated to the closed position shown in FIG. 7. The apples 43 will thereby be released as described hereinbefore. The vacuum head is thereafter elevated out of the storage bin 28 and back to the pickup station to receive a new load of apples.

The method of operation of the apparatus of the present invention will now be described in connection with the control circuitry for the electric and pneumatic control components, such circuitry being shown in FIGS. 16A and 16B. Various of the limit switches shown in the circuitry are located with reference to FIG. 1 of the Drawings.

Figure 16A:
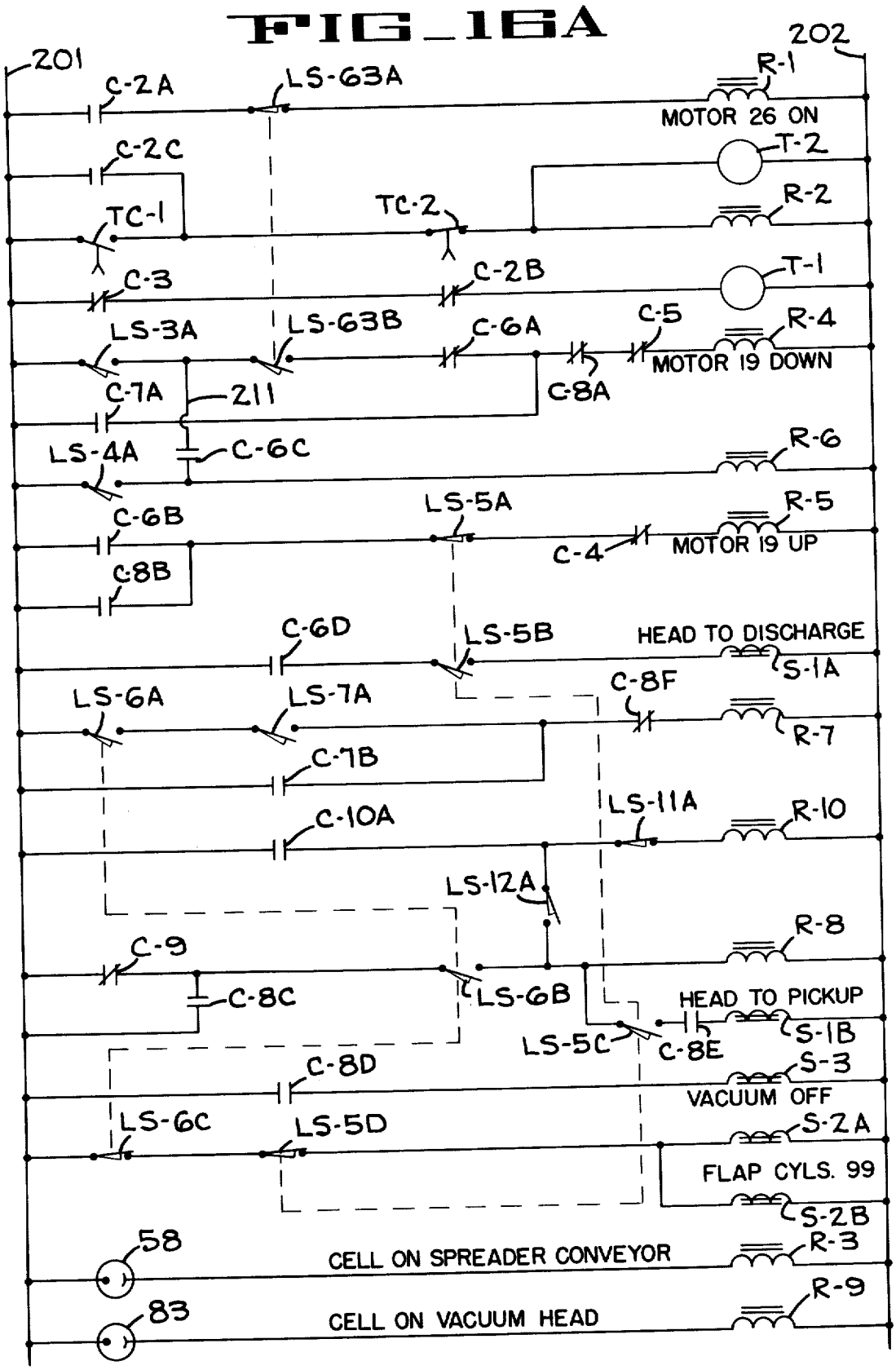
FIGS. 16A and 16B are a schematic diagram of the control circuitry for the apparatus of the present invention.
Figure 16B:
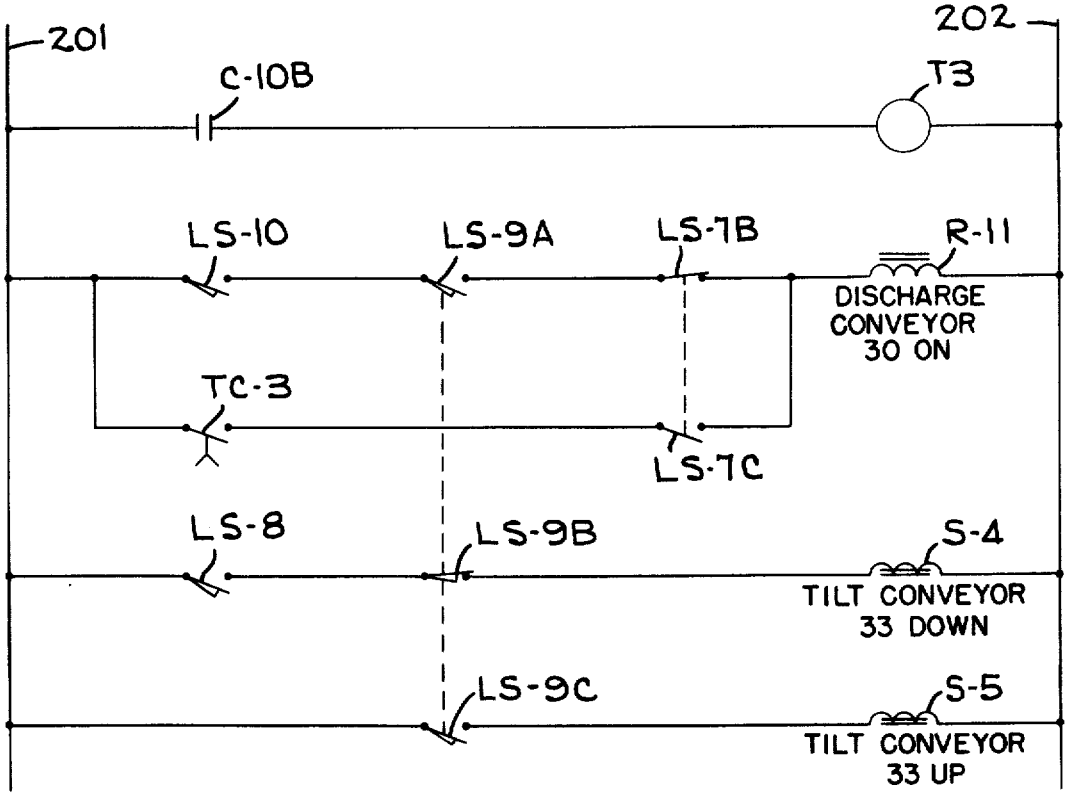

FIGS. 16A and 16B together represent the electrical circuitry for the bin filling apparatus. For ease in interpreting the diagrams, all relays have been given a number preceded by the prefix "R" while each set of contacts is identified by a prefix "C" followed by a number which is the same as the relay with which such contacts are associated. The contacts are shown in their "normal" positions, i.e., the positions which they assume when their associated relays are unenergized. The solenoids are given the prefix "S", and the limit switches are given the prefix "LS", said limit switches being shown in their unengaged positions. Time delay relays are given the prefix "T" while the contacts associated therewith are given the prefix "TC" followed by the number associated with the energizing relay.

The control circuitry of FIG. 16A will be seen to include main power leads 201 and 202. The portion of the control circuit which controls motor 26 (which, as previously described, concurrently drives the horizontal accumulation conveyor 23, the inclined spreading conveyor 22 and the soft feeding roller 54) includes a lead extending between the main power leads and having connected in series thereon a relay R-1 adapted to close contacts (not shown) to energize the motor 26, a normally open contact C-2A operatively associated with a relay R-2, and a normally closed section LS-63A of the limit switch 63. As best seen in FIG. 4, the limit switch 63 is positioned to be actuated by the pivotable end bar 62 which extends across the downstream end of the accumulation conveyor 23. Spring (not shown) are mounted between the end bar and adjacent portions of the frame such that the limit switch is actuated by the end bar only after a predetermined number of apples abut against the end bar. That is to say, the springs which outwardly bias the end bar are adapted to prevent the limit switch from being actuated until after a predetermined number of apples have accumulated against the end bar while the horizontal accumulation conveyor continues to move under such apples. Thus, the limit switch 63 will not be actuated by a few apples 43*a* which might initially abut the bar 62 but will only be actuated when the accumulated mass of apples moves from the feed roller 54 to the end bar 62. At that time the switch LS-63A is opened to de-energize the relay R-1, thereby stopping the accumulation conveyor 23 and enabling the layer of apples thereon to be transferred from the conveyor to the bin.

The motor 26 is started by energization of relay R-2 which closes contact C-2A. Relay R-2, in turn, is energized by the de-energization of relay R-3 which is connected in series with the photocell 58 on the spreader conveyor 22 and will thereby be de-energized when the layer of accumulated apples on the spreader conveyor blocks the light to the photocell. When the light from the opposing light source 57 (see FIG. 4) to the photocell PC-58 is interrupted, current will flow through closed contact C-2 to the timer T-1. The timer T-1 includes a normally open contact TC-1 that is connected in series with the relay R-2. The timer T-1 closes its contact TC-1 only after it has been energized for a predetermined period of time of three seconds. The predetermined time period of three seconds is chosen to insure that the inclined spreading conveyor 22 and feed roller 54 will not be activated prematurely when individual apples rolling down the spreading conveyor break the beam but will only activate after the apples have accumulated on the spreading conveyor such that they interrupt the light to the photocell PC-58 continuously for three seconds. Thus, the timer T-1 serves to sense whether the spreading conveyor 22 has been loaded with enough apples so that a complete array can be fed to the accumulation conveyor 23. When the light to the photocell 58 is interrupted for three seconds, the contact TC-1 will close to energize the relay R-2; this, in turn, will close contact C-2A to energize the relay R-1 and thus the motor 26 (assuming that the switch LS-63 is not actuated). Then, the accumulated array of apples will be fed to the accumulation conveyor, with such feeding continuing until a complete layer of apples has accumulated on the conveyor and the downstream row of such layer abuts against the end bar 62 to thereby actuate the limit switch LS-63. The timer contact TC-1 is sealed by a contact C-2C so that the accumulation conveyor will continue to operate once it is started.

The timer T-2 is provided in the circuit to shut off power to the motor 26 after the motor has been operated for a predetermined length of time, such as ten seconds. The timer T-2 is connected so as to be energized when the contact TC-1 closes, and its contact TC-2 will open after the second delay to de-energize relay R-2. Thus, the timer T-2 functions to stop the accumulation and spreading conveyors and the feed roller (if not stopped sooner by the limit switch LS-63) to insure that the accumulation conveyor will be completely transversely filled with apples.

Once the horizontal accumulation conveyor 23 has been stopped with a complete layer of apples thereon by the activation of limit switch LS-63, the vacuum head 17 can be lowered toward the accumulation conveyor. The reversible motor 19 (FIG. 1) which raises and lowers the vacuum head is operated by a magnetic starter which includes relays R-4 and R-5. When the relay R-4 is energized, appropriate contacts in the motor starter are closed to energize the motor 19 so as to lower the vacuum head. When the relay R-5 is energized, other contacts in the starter are closed to energize the motor 19 to raise the vacuum head. As shown in FIG. 1, the limit switch LS-3 is mounted to the main frame 11 so that it is engaged by the carrier 14 when the vacuum head is positioned directly above the accumulation conveyor 23 so that the vacuum head may be lowered to pick up apples, that is, when the carrier is in its home or pickup position. The limit switch LS-4, as shown in FIG. 1, is mounted to the main frame 11 such that an appropriately positioned actuator on a vertically extending switch actuating rod 150 mounted atop the vacuum head 17 will engage the actuating arm of the switch when the vacuum cups 77 are brought into contact with the apples on the accumulation conveyor. With the foregoing arrangement, the relay R-4 will be energized when the carrier 14 is in the home position above the accumulation conveyor (LS-3 actuated) and when the switch LS-63 is actuated by a load of apples abutting against the end bar 62; this lowers the vacuum head. When the switch LS-4 is subsequently actuated by the vacuum head as the vacuum head reaches the fruit pickup position, the relay R-6 is energized to thereby open the contact C-6A and thus de-energize the relay R-4 to stop the lowering of the vacuum head; the vacuum head will then have been lowered for enough to press the suction cups 77 against apples on the accumulation conveyor.

The relay R-5 will be energized when the relay R-4 is de-energized through the closing of contacts C-6B and C-4 thereby causing the motor 19 to immediately initiate the raising of the vacuum head with the apples engaged on the suction cups 77. It will be seen from FIG. 16A that the relay R-5 is held energized during the lifting of the vacuum head by a sealing contact C-6C.

The limit switch LS-5, as shown in FIG. 1, is mounted on the frame 11 so that it will be actuated by an appropriately positioned actuator on the actuating rod 150 when the vacuum head 17 is fully elevated. The relay R-5 will be de-energized when the vacuum head actuates section LS-5A of the limit switch LS-5.

After the vacuum head is thus fully elevated, the piston of pneumatic cylinder 16 is retracted to pull the carrier 14 to a position directly over the empty bin 28 into which the apples are to be transferred, that is, the carrier is moved to the discharge position (such position being shown in FIG. 1 in phantom outline). Air flow to the cylinder 16 is controlled by a double-acting solenoid valve which has a reciprocal plug therein having detents which cause the plug to be held in either of its two valve-controlling positions even though the solenoid which moved the plug has been deactivated; thus, the solenoid actuators need only receive a short duration pulse at the beginning of the piston movement to cause the entire retraction or extension of the piston. The stopping of the movement of the carrier occurs automatically at the end of the piston stroke. The solenoid valve has a solenoid actuator S-1A and a solenoid actuator S-1B. The first solenoid actuator S-1A, when energized, forces the valve plug into a position to cause the piston of cylinder 16 to retract and thus pull the carrier and vacuum head 17 to the discharge position overlying the bin. When the other solenoid actuator S-1B has been energized, the plug is moved to its other position such that the air flow to the cylinder causes the piston thereof to extend and push the carrier and the vacuum head back to the pickup position above the accumulation conveyor 23.

The solenoid actuator S-1A is connected in series with a normally open contact C-6D and a normally open section LS-5B of the limit switch LS-5. Since the contact C-6D is closed by the pickup of a load of apples, when the vacuum head 17 is fully raised such that it closes the limit switch section LS-5B, the solenoid actuator S-1A will be energized to cause the cylinder 16 to pull the vacuum head, which is laden with the apples to be transferred, to the discharge position. This movement continues (even though the solenoid S-1A is deactivated when contact C-6B opens as the limit switch LS-3A opens) until the vacuum head is in the discharge position.

As shown in FIG. 1, another limit switch LS-6 is mounted to the main frame 11 so that its actuator will be engaged by the carrier 14 when the carrier is in the discharge position. When the switch LS-6 is actuated, the motor 19 will be energized to lower the vacuum head and the apples depending therefrom into the underlying bin. The portion of the control circuitry which so starts the motor 19 to lower the vacuum head includes a control relay R-7. The relay R-7 is connected in series with a normally open section LS-6A of the limit switch LS-6 and a normally open section LS-7A of a limit switch LS-7. The limit switch LS-7, as shown in FIG. 1, is mounted to the frame of the lower track assembly 12 in a position to be engaged by a bin when such bin is at the filling station 32 so that it may be filled with apples. The relay R-7 will thus be energized when a bin is in position to be filled and the switch LS-6 is actuated by the carrier 14 at the discharge position above such bin. When the relay R-7 is energized, it closes contact C-7A so as to energize the relay R-4 and thereby energize the motor 19 to lower the vacuum head. The limit switch sections LS-6A and LS-74 are sealed by a contact C-7B which is closed by the relay R-7.

The termination of the lowering of the vacuum head 17 into the bin and the initiation of the raising of the vacuum head from the bin is made when the light reflected to the photocell 83 from the reflector 86 is interrupted by an apple or apples. As previously indicated, the light to the photocell 83 will be interrupted when either the reflector 86 or the photocell 83 drops into an empty space between the apples already filled in the bin or when either the reflector or the photocell is forced upwardly on its respective slidable bracket 87 by apples in the bin or by the bottom of the bin. The photocell 83 is connected as shown in FIG. 16A to deenergize a relay R-9 when it is blocked. The lowering of the motor is thus terminated when the relay R-9 closes contact C-9 to energize the relay R-8 which opens contact C-8F to de-energize the relay R-7 thereby opening the contact C-7A to de-energize the relay R-4. A normally open contact C-8B is also closed by the energization of the relay R-8 to energize the relay R-5 through closed switch section LS-5A and closed contact C-4 to cause the motor 19 to raise the vacuum head from the empty bin. The relay R-5 will be de-energized when the switch section LS-5A is opened in the same manner as described hereinbefore in connection with the raising of the vacuum head from the accumulation conveyor 23. A normally open contact C-8C is provided for sealing the contact C-9 to keep the relay R-8 energized until the switch LS-6 is deactuated by the return of the carrier 14 to the pickup position. Since the relay R-8 remains energized as the vacuum head is lifted to its uppermost position, contact C-8A remains open to prevent the head from being lowered and contact C-8E remains closed to actuate the solenoid S-1B when switch section LS-5C closes to send the vacuum head back to the fruit pickup position.

The hinged flaps 89 are lowered with the lowering of vacuum head 17 toward the bin. The two pneumatic cylinders 94 which upwardly pivot the flaps and normally keep them in raised positions are controlled by single-acting, solenoid-operated valves which are actuated by solenoids S-2A and S-2B. The solenoid-operated valves which control the air flow to the cylinders 94 are connected so that the solenoids S-2A and S-2B normally actuate the valves to pressurize the cylinders so as to retract the pistons thereof and thus hold the flaps upwardly against the spring pressure which tends to extend them downwardly. When the air flow to the cylinders is reversed by de-actuation of solenoids S-2A and S-2B, the springs 95 will quickly lower the flaps. Thus, with the switch section Ls-6C opened (with the vacuum head at the discharge position), the solenoids S-2A and S-2B will be de-energized when the switch section LS-5D is opened as the vacuum head is lowered to drop the flaps. The flaps are raised when the vacuum head is subsequently returned to its full up position to again open LS-5D.

As shown in FIG. 7, and as previously discussed, the valve assembly which controls the communication of the vacuum pump with the plenum chamber 74 in the vacuum head includes the pneumatic cylinder 103 which reciprocates the apertured valve plate 99. The flow of air to the cylinder 103 is controlled by a single-acting spring-loaded solenoid valve (not shown) having a solenoid actuator S-3. When the solenoid S-3 is de-energized, the air flow to the cylinder 103 is reversed so as to extend the piston thereof to thereby extend the plate and permit a vacuum to be drawn in the plenum chamber of the vacuum head. When the solenoid S-3 is energized, the piston of the cylinder is retracted to retract the valve plate 99 and thus cut off the vacuum source from the vacuum head. It will be seen from FIG. 16A that the solenoid S-3 is arranged to be energized when a normally open contact C-8D is closed by energization of the relay R-8. Thus, when the relay R-8 is energized as apples interrupt the light to the photocell 83 (as the bin fill level is reached), the solenoid S-3 is energized to cause the cylinder 103 to retract the valve plate 99 to cut off the vacuum source to the vacuum head and thus release the apples from the suction cups 77. Subsequently, when the carrier 14 is moved back to the pickup position and the actuator of the switch LS-6 is disengaged, switch section LS-6B is opened and the relay R-8 is de-energized to open the contact C-8D and to thereby de-energize the solenoid S-3. This reverses the air flow to the cylinder 103 such that the vacuum source again is able to depressurize the vacuum head.

The control circuitry further includes means for preventing the bins from being overfilled. As shown in FIG. 1, the actuator rod 150, which extends vertically upwardly from the top of the vacuum head 17, includes an appropriately located actuator to actuate a limit switch LS-12 mounted to the frame. The actuator is located on the rod 150 such that the switch LS-12 will be actuated when the vacuum head has been lowered to a bin which has been filled to a selected maximum level. That is to say, when the vacuum head has been lowered (with apples engaged on the suction cups 77) into a bin which has all but the last layer of apples placed therein the switch LS-12 will be actuated. If at this same time the photocell 83 indicates that the layer of apples on the cups 77 is to be dropped, the contact C-9 closes and a circuit is closed through LS-6B and LS-12A to a relay R-10. The relay R-10 is thereafter sealed on by contact C-10A. As shown in FIG. 16B, the energization of relay R-10 closes contact C-10B to actuate a time delay relay T-3. After a predetermined time delay period, to permit the vacuum head to be elevated out of the bin 28, contact TC-3 will close a circuit through LS-7C to energize relay R-11, the latter relay being connected to activate the motor 30 and thereby start the bin advance conveyor 31.

The conveyor 31 is driven while the relay R-11 remains activated to permit one of the cross bars 38 to push the filled bin 28 out of the filling station 32 and onto a take-away conveyor at the downstream end of the lower track assembly 12 (see FIG. 1). As the bin is pushed away from the conveyor 31, a limit switch LS-11 will be actuated to break the circuit to relay R-10. The bin advance conveyor 31 will continue to advance however after the filled bin clears the limit switch LS-7 (and thereby opens LS-7C) if a circuit to relay R-11 is closed through limit switch LS-10 and switch section LS-9A. The limit switch LS-10 (FIG. 1) is used to sense that the tilting section 33 of the track assembly is in its upright (horizontal) position while the switch LS-9 is used to sense that an empty bin is in position at the end of tilting section 33 to be fed into filling station 32. Thus, if an empty bin is ready, the conveyor 31 continues to run to bring the empty bin into position to be filled until the limit switch LS-7 is tripped to open LS-7B and de-energize the relay R-11. The empty bin will then be ready to be filled, and the aforedescribed process will be repeated.

Finally, with reference to FIG. 16B, it will be seen that bins are provided to the loading position (as shown in FIGS. 2 and 3) by the activation of a limit switch LS-8 indicating that a bin is at the end of the feed track 29. If there is no bin at the end of tilting track section 33, the switch section LS-9B will be closed and the closing of LS-8 will energize a solenoid S-4 which operates the valve to cause the pneumatic cylinder 34 to tilt the track section 33 to the FIG. 2 position. When the limit switch LS-9 is subsequently activated by the empty bin, the section LS-9B opens to de-energize S-4 and a section LS-9C closes to energize a solenoid S-5 which reverses the air flow to the cylinder 34 to return the track section 33 to its horizontal position (FIG. 3).

A bin filling apparatus has been disclosed which receives empty storage bins and relatively fragile articles, particularly apples, to be packed therein. The apparatus sequentially positions empty storage bins at a filling station and provides a close-packed random array of apples to be stored in the bins for pickup. A vacuum head is provided to pick up the array of apples, transport it laterally, and deposit it within a storage bin. This process is continued until the bin is filled and can be discharged and a new empty bin put in its place.

Although the best mode contemplated for carrying out the present invention has been herein shown and described, it will be apparent that modification and variation may be made without departing from what is regarded to be the subject matter of the invention.

What is claimed is:

1. A bin filling apparatus for filling a bin with generally round articles of produce of random size and shape including an inclined spreading conveyor, an accumulation conveyor generally horizontally oriented for accumulating a mass of said articles, said accumulation conveyor being aligned with said spreading conveyor so as to receive articles therefrom, said spreading conveyor having a lower end at substantially the level of the accumulation conveyor and being disposed between a source of supply of the articles and the accumulation conveyor thereby providing a path for the articles therebetween, said source of supply of the articles being of substantially less width than said spreading and accumulation conveyors, means for selectively driving said accumulation conveyor in one direction, means for driving said spreading conveyor in the upward direction opposite to the direction of movement of the accumulation conveyor, means for actuating said means for driving said accumulation conveyor when the articles accumulate on said spreading conveyor a predetermined distance up the incline whereby the articles are caused to cascade gently downward in spreading fashion on said spreading conveyor toward the accumulation conveyor and are transported in close packed random array toward the end of the accumulation conveyor which is remote from said spreading conveyor, a movable transport head disposed above the accumulation conveyor in a first position to engage the mass of articles, and means for selectively moving the head from said first position to a second position to remove the mass of articles from the accumulation conveyor and to transport the mass of articles to and into a storage bin.

2. The bin filling apparatus of claim 1 including a stop member extending transversely to the direction of movement of the articles adjacent the junction of the spreading and accumulation conveyors, and means for rendering said stop member ineffective simultaneously with the driving of the accumulation conveyor.

3. The bin filling apparatus of claim 2 wherein said stop member comprises a soft roller suspended above the lower end of said spreading conveyor to form the stop for said articles, said means for rendering said stop member ineffective comprising means for rotating said soft roller simultaneously with the driving of the accumulation conveyor to urge the articles from the lower end of said spreading conveyor onto the accumulation conveyor.

4. The bin filling apparatus of claim 1 together with resilient means suspended above and extending toward said spreading conveyor and operating to contact and decelerate articles rolling down the incline.

5. The bin filling apparatus of claim 1 together with means for sensing when the mass of articles is adjacent the downstream end of the accumulation conveyor, said last named means operating to initiate an article removal cycle by the transport head.

6. The bin filling apparatus of claim 5 wherein said sensing means is operatively connected to said means for driving the accumulation conveyor so as to stop the movement of the accumulation conveyor when said mass of articles is sensed.

7. The bin filling apparatus of claim 1 together with a shear bar suspended above the accumulation conveyor so that the articles pass thereunder, said shear bar being located so that articles engaged and picked up by the transport head and laterally overlapping an edge thereof are separated from the mass of articles being removed and remain on the accumulation conveyor for subsequent pickup.

8. The bin filling apparatus of claim 1 wherein the transport head is configured to fit within the bin so that the sides of the head are closely spaced from the bin walls, together with side protective pads attached to the transport head which are movable between a retracted position during article engagement on the accumulation conveyor and a position depending from the head while within the bin, whereby the articles are protected from damage by contact with the bin walls.

9. The bin filling apparatus of claim 1 wherein said transport head is provided with a plurality of closely spaced vacuum cups on the underside thereof for picking up said mass of articles.

10. Bin filling apparatus for transferring articles of produce of generally rounded shape and of random sizes and shapes from an article supply source to a storage bin, said apparatus comprising an accumulation conveyor having a generally horizontal orientation, an inclined spreading conveyor with a lower end adjacent to said accumulation conveyor and extending between the article supply source and said accumulation conveyor so that articles from the source of supply are deposited thereon, said source of supply being relatively narrow as compared to the width of said spreading conveyor, means for driving said accumulation and spreading conveyors in opposite directions with said spreading conveyor running in the uphill direction whereby collected articles on said spreading conveyor cascade gently down the incline while spreading to fill the width of said spreading conveyor and are moved away therefrom on said accumulation conveyor in close packed random array toward the end remote from said spreading conveyor, means disposed at the remote end of said accumulation conveyor for detecting the close packed array, said last named means providing a removal signal, a movable vacuum transport head operable between a position overlying said accumulation conveyor and a position within the storage bin, closely spaced vacuum pickup heads mounted on said transport head for engaging the close packed array, said transport head being responsive to said removal signal whereby said array of articles is removed from said accumulation conveyor and deposited within the bin.

11. A bin filling apparatus as in claim 10 together with a soft surfaced stop roller suspended above the lower end of said spreading conveyor for contacting the articles, and means for selectively rotating said stop roller in a direction to urge the articles to advance on said accumulation conveyor.

12. A bin filling apparatus as in claim 11 together with means for contacting and slowing the gravitational movement of the articles deposited on said spreading conveyor.

13. A bin filling apparatus as in claim 10 together with a shear bar disposed transversely to the direction of movement of the articles and above said accumulation conveyor so that the articles pass thereunder, said shear bar being positioned to force said vacuum pickup heads to release articles which extend laterally beyond the rearward side of said transport head.

14. A bin filling apparatus as in claim 10 together with retractable protection shields on the sides of said transport head, said shields being retracted while the close-packed array of articles is being engaged and said shields being extended downwardly and inwardly to shield the articles from the bin walls while the transport head is within the bin.

15. A bin filling apparatus as in claim 14 wherein said protection shields have attached thereto a flexible depending flap to absorb the impact between underlying layers of produce in the bin and the articles deposited within the bin adjacent to the bin walls.

16. A bin filling apparatus as in claim 10 wherein said transport head includes means for detecting the fill level in the bin and for providing a release signal, said vacuum pickup heads being responsive to said release signal to release the close-packed array within the bin.

17. A bin filling apparatus as in claim 16 wherein said means for detecting the fill level comprises a photodetector depending from said transport head to a position below the engaged portion of the close-packed array, and means for transmitting a light beam depending from said transport head, said photodetector being located so as to receive said light beam until blocked by the articles in the bin.

18. A bin filling apparatus as in claim 17 together with a collapsible mounting for said photodetector so that contact with an underlying surface within the bin during filling will cause the photodetector mounting to collapse upwardly to cause the light beam to be blocked by the articles depending from said transport head.

19. Apparatus for receiving generally rounded articles from an article supply source and for spreading the articles laterally in a close-packed array over a predetermined width wherein the outlet from the supply source is substantially narrower than the predetermined width, said apparatus comprising an inclined spreading conveyor with means mounting an elevated end adjacent to the narrow supply source outlet, means for intermittently driving said spreading conveyor to advance toward said elevated end whereby articles collecting thereon while said spreading conveyor is stationary tend to spread transversely at the lower end thereof while said spreading conveyor is being driven.

20. Apparatus as in claim 19 together with resilient fingers overlying said spreading conveyor whereby articles rolling down the incline are contacted and slowed.

21. Apparatus as in claim 19 together with means for sensing when the articles have collected on said spreading conveyor a predetermined distance up the incline and for providing a signal indicative thereof, said means for intermittently driving being responsive to said signal.

22. A method of filling loose articles of produce of generally rounded configuration and of random sizes and shapes, such as apples, into a bin, said method comprising the steps of assembling a layer of said articles on a generally flat surface in a closely packed and randomly oriented array where said articles are in abutting engagement with each other throughout the layer, moving a vacuum head with a plurality of depending vacuum pickup cups over and onto said layer to cause the cups to grip substantially all of the articles in the layer within the confines of the vacuum head, there being substantially more vacuum cups on said vacuum head than articles to be gripped, moving the vacuum head over and into said bin, removing the vacuum from the cups to release the layer of articles in the bin directly adjacent to the previously loaded layer of articles or to the bottom of the bin, and repeating the aforesaid steps until the bin is filled to the desired level, wherein the step of assembling the layer of articles comprises randomly receiving the articles from a supply conveyor having a width substantially narrower than said layer, and causing the articles to gravitate over an intermediate conveyor between said supply conveyor and the assembling area, which intermediate conveyor is driven in a direction opposite to the direction of movement of the articles to cause the articles to uniformly spread to the width of the layer to be picked up in the assembling area.

23. A method of filling as set forth in claim 22 including temporarily stopping the flow of articles into the assembling area until a sufficient number of articles have accumulated on said intermediate conveyor, and then releasing said articles to permit them to flow into and fill said assembling area in said closely packed array.

24. In combination with a supply conveyor for randomly feeding generally rounded articles of produce and an accumulation conveyor for receiving said articles and accumulating them in a closely packed layer and having a width measured transversely of the direction of movement of the articles which is substantially larger than that of said supply conveyor, an intermediate spreading conveyor located between said supply conveyor and said accumulation conveyor, means mounting said spreading conveyor inclined downwardly from said supply conveyor to said accumulation conveyor, and means for driving said spreading conveyor in a direction opposite to that of the movement of the articles from the supply conveyor to the accumulation conveyor so that said articles are caused to uniformly spread out to the width of the accumulation conveyor as they gravitate down said spreading conveyor.

25. The combination set forth in claim 24 including means for blocking the movement of articles down said spreading conveyor until they accumulate a predetermined distance up the incline, and means for releasing said blocking means and for simultaneously initiating movement of said accumulation conveyor to cause said articles to move in a closely packed mass onto said accumulation conveyor.

26. The combination set forth in claim 25 wherein said means for initiating movement of said accumulation conveyor also initiates movement of said spreading conveyor, and a common drive means connected to drive both said accumulation and spreading conveyors.

* * * * *